US009315972B2

(12) United States Patent
Anisy et al.

(10) Patent No.: US 9,315,972 B2
(45) Date of Patent: Apr. 19, 2016

(54) WEAR ASSEMBLY AND LOCK MECHANISM

(75) Inventors: Mark Anisy, Revesby (AU); Paul Surrey, Revesby (AU); Trevor Hibbert, Revesby (AU)

(73) Assignee: Cutting Edges Equipment Parts Pty Ltd., Revesby, NSW (AU)

( * ) Notice: Subject to any disclaimer, the term of this patent is extended or adjusted under 35 U.S.C. 154(b) by 196 days.

(21) Appl. No.: 13/579,023

(22) PCT Filed: Feb. 15, 2011

(86) PCT No.: PCT/AU2011/000157

§ 371 (c)(1),
(2), (4) Date: Oct. 29, 2012

(87) PCT Pub. No.: WO2011/097689

PCT Pub. Date: Aug. 18, 2011

(65) Prior Publication Data

US 2013/0185964 A1 Jul. 25, 2013

(30) Foreign Application Priority Data

Feb. 15, 2010 (AU) ..... 2010900613

(51) Int. Cl.
*E02F 9/28* (2006.01)

(52) U.S. Cl.
CPC ..... *E02F 9/2883* (2013.01); *E02F 9/2825* (2013.01); *E02F 9/2841* (2013.01)

(58) Field of Classification Search
USPC ..... 37/448–459; 172/719, 772, 772.5, 172/701.2, 701.3
See application file for complete search history.

(56) References Cited

U.S. PATENT DOCUMENTS 2,312,802 A * 3/1943 Crawford ..... 37/459
2,483,032 A * 9/1949 Baer ..... 37/457
3,126,654 A * 3/1964 Eyolfson et al. ..... 37/457
3,410,010 A * 11/1968 Ratkowski ..... 37/454

(Continued)

FOREIGN PATENT DOCUMENTS

AU 2007243386 B2 10/2011
GB 2091200 A 7/1982

OTHER PUBLICATIONS

Australian Patent Office, International Search Report in PCT App. No. PCT/AU2011/000157, Jun. 3, 2011.

(Continued)

*Primary Examiner* — Matthew D Troutman
(74) *Attorney, Agent, or Firm* — Cahn & Samuels, LLP

(57) ABSTRACT

In at least one embodiment, a wear assembly (1) includes a wear member (10, 100, 110) to be mounted to an implement or apparatus to be protected, a base member (30, 300, 330) to be attached to the implement or apparatus, a lock member (20, 21) to lock the wear member (10, 100, 110) to the base member (30, 300, 330), the wear member (10, 100, 110) including or receiving the lock member (20, 21) and the base (30, 300, 330) including at least one aperture (33) in which is located a releasable retaining means (40) to releasably hold a portion (22) of the lock member (20, 21). The wear member can be: shroud; a tile shroud; a tooth; a replaceable tip. The base member can be: a base for a shroud, a base for a tile shroud; an adaptor for a tooth; an adaptor for a replaceable tip. The implement or apparatus can be: an excavation bucket; a grader blade; a chute; an excavation bucket edge; an excavation bucket surface; dump or haul truck load carrier; an earth, ore or mineral handling apparatus.

16 Claims, 17 Drawing Sheets

(56) References Cited

U.S. PATENT DOCUMENTS

| | | | | | |
|---|---|---|---|---|---|
| 3,520,224 | A | * | 7/1970 | Elbert et al. | 411/512 |
| 3,650,053 | A | * | 3/1972 | Baer | 37/457 |
| 3,767,266 | A | * | 10/1973 | Krekeler | 299/107 |
| 3,839,805 | A | * | 10/1974 | Stepe | 37/454 |
| 3,856,359 | A | * | 12/1974 | Krekeler | 299/104 |
| 3,997,989 | A | * | 12/1976 | Stepe | 37/457 |
| 4,187,035 | A | | 2/1980 | Colburn | |
| 4,663,867 | A | * | 5/1987 | Hahn et al. | 37/459 |
| 4,823,487 | A | * | 4/1989 | Robinson | 37/457 |
| 4,918,843 | A | | 4/1990 | Kiesewetter et al. | |
| 5,009,017 | A | * | 4/1991 | Diekevers et al. | 37/456 |
| 5,241,765 | A | * | 9/1993 | Jones et al. | 37/398 |
| 5,311,681 | A | * | 5/1994 | Ruvang et al. | 37/457 |
| 5,666,748 | A | * | 9/1997 | Emrich et al. | 37/453 |
| 5,713,145 | A | * | 2/1998 | Ruvang | 37/458 |
| 5,913,605 | A | | 6/1999 | Jusselin et al. | |
| 5,983,534 | A | * | 11/1999 | Robinson et al. | 37/459 |
| 6,032,390 | A | * | 3/2000 | Bierwith | 37/456 |
| 6,070,345 | A | * | 6/2000 | Akaki et al. | 37/407 |
| 6,085,448 | A | * | 7/2000 | Gale et al. | 37/458 |
| 7,503,629 | B2 | * | 3/2009 | Klabisch et al. | 299/113 |
| 7,578,081 | B2 | * | 8/2009 | Bearden et al. | 37/455 |
| 8,464,444 | B2 | * | 6/2013 | Bierwith | 37/457 |

OTHER PUBLICATIONS

IP Austrailia, Patent Examination Report No. 1 in AU Patent App. No. 2011203147, Oct. 23, 2014.

* cited by examiner

WEAR ASSEMBLY AND LOCK MECHANISM

This application is the National Stage of International Application No. PCT/AU2011/000157, filed on Feb. 15, 2011, which claimed the benefit of Australian Application No. 2010900613 filed Feb. 15, 2010, which are hereby both incorporated by reference. The International Application No. PCT/AU2011/000157 was published on Aug. 18, 2011.

FIELD OF THE INVENTION

The present invention relates to wear assemblies, locks and bases utilised in attaching wear members, such as shrouds or tile shrouds, to implements, such as buckets and excavation tools, chutes, mills or tips or teeth to adaptors mounted on such implements.

BACKGROUND OF THE INVENTION

There exist many different systems for the interlocking of components of a wear assembly. The disassembly of such wear assemblies tends to be a tedious and difficult task and users are seeking better and more efficient disassembly processes which do not involve a hammer to effect the disassembly by the knocking out of components.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a wear assembly including a wear member to be mounted to an implement or apparatus to be protected, a base member to be attached to the implement or apparatus, a lock member to lock said wear member to said base member, said wear member including or receiving said lock member and said base including at least one aperture in which is located a releasable retaining means to releasably hold a portion of said lock member.

The portion of said lock can be a shaft, or a spigot or a shaped shaft or a shaped spigot.

The releasable retaining means can include a spring or spring clip which will engage a groove on said portion of said lock.

The wear member, in the vicinity of said aperture, can include engaging surfaces which will allow said lock to pivot into and out of a locked condition, in which locked condition said wear member is secured and locked to said base and thus said implement, preferably the engaging surfaces are of a curved profile.

A wear assembly can be such that one or both of said lock or said wear member includes a lever engagement formation which allows a user to utilise a lever to pivot said lock or said wear member from a locked to an unlocked condition.

The spring clip of said base and said groove on said portion can provide sufficient retaining force to prevent said lock member or said wear member from pivoting during use of said implement or apparatus.

The spring clip can be located in said base in a passage which opens through a surface of said base which is at approximately 90 degrees to said at least one aperture.

The spring clip can be such that it will only release said portion and said groove of said lock when a force in a direction opposite to a lock engagement direction is applied to said lock member or said wear member relative to said base.

The lock portion can include at least one tapered engagement surface which will expand said spring clip as said lock portion moves into said at least one aperture.

The lock member can be separate from said base and said wear member, said wear member including means to receive said base in a first direction and having a lock receiving aperture which opens in a second direction so that at least a portion of said lock member can move into said lock receiving aperture to engage said base, and which allows said portion of said lock member to be received in said aperture in said base.

The lock member can include at least one first bearing surface to engage or abut said wear member or said base and at least one second bearing surface to engage or abut said base thereby preventing said wear member from moving relative to said base member in a direction opposite to said first direction.

The wear member can include an abutment surface to engage said base or said implement or apparatus, said abutment surface once engaged with said base or said implement or apparatus will prevent said wear member from moving further in said first direction.

Wing means can be provided on said lock member to cooperate with said wear member to thereby enable said lock to be moved or assisted to be moved to an unlocked condition by means of a crow bar or lever pivotably engaging said wing means and said wear member.

The spring clip is prevented from exiting the passage once said wear member is arranged on said base member.

The present invention also provides abase for a wear assembly for use with an implement or apparatus, said base including at least one formation to cooperate with a wear member which is to be secured to said implement or apparatus, said base being adapted to be secured to said implement and characterised in that said base includes an aperture to receive a spigot or shaft of a lock member, said base including a retaining means passage which will allow a retaining means to be positioned in said passage, in alignment with said aperture, and which will engage said spigot or shaft.

The retaining means passage have a longitudinal axis at 90° to the axis of said aperture.

The retaining means passage can open to one of: a rear side of said base, a front side of said base; a lateral side of said base.

The aperture can be a blind aperture or a through aperture.

The passage can be a blind passage or a through passage.

The retaining means passage can receive a spring or spring clip, such as a split toroidal spring.

The engagement of said wear member with said base, can prevent said retaining means from exiting said retaining means passage.

The present invention further provides a lock for a wear assembly for use in locking a wear member to a base, said lock having a body portion at a first end of which is located a pivot bearing formation, and between said pivot bearing formation and a second oppositely located end of said body portion there is located a spigot or shaft to be held by said base.

The lock can move to said locked condition by means of rotation around said pivot formation relative to one or both of said wear member and said base.

The spigot or shaft can include means to be held by releasable retaining means located on said base.

The lock member and said wear member can be integrally formed.

The lock member can be formed on a tile shroud.

At said second end said body portion can also include a transverse portion.

The transverse portion can extend away from said body portion in a direction generally parallel to the extension direction of said spigot or shaft from said body.

The body portion or said transverse portion can include a formation, recess or shoulder to allow engagement by a lever or crow bar tip to pivot said lock from a locked condition to an unlocked condition.

The transverse portion can include a tapered end so that its interaction with said base and wear member, results in movement of said wear member relative to said base as said lock member is being moved to said locked condition.

The body portion can include laterally extending wings or extensions, which cooperate with said wear member or said base, to provide a user with an alternative or additional location to apply a pivoting force to said lock to move it to an unlocked condition.

For the wear assembly or lock member described above the wear member can be one of: a shroud; a tile shroud; a tooth; a replaceable tip.

For the wear assembly or base described above the said base member or the base can be one of: a base for a shroud, a base for a tile shroud; an adaptor for a tooth; an adaptor for a replaceable tip.

For the wear assembly or base as described above the implement or apparatus can be one of: an excavation bucket; a grader blade; a chute; an excavation bucket edge; an excavation bucket surface; dump or haul truck load carrier; a mill; an earth, ore or mineral handling apparatus.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

Figure 1:
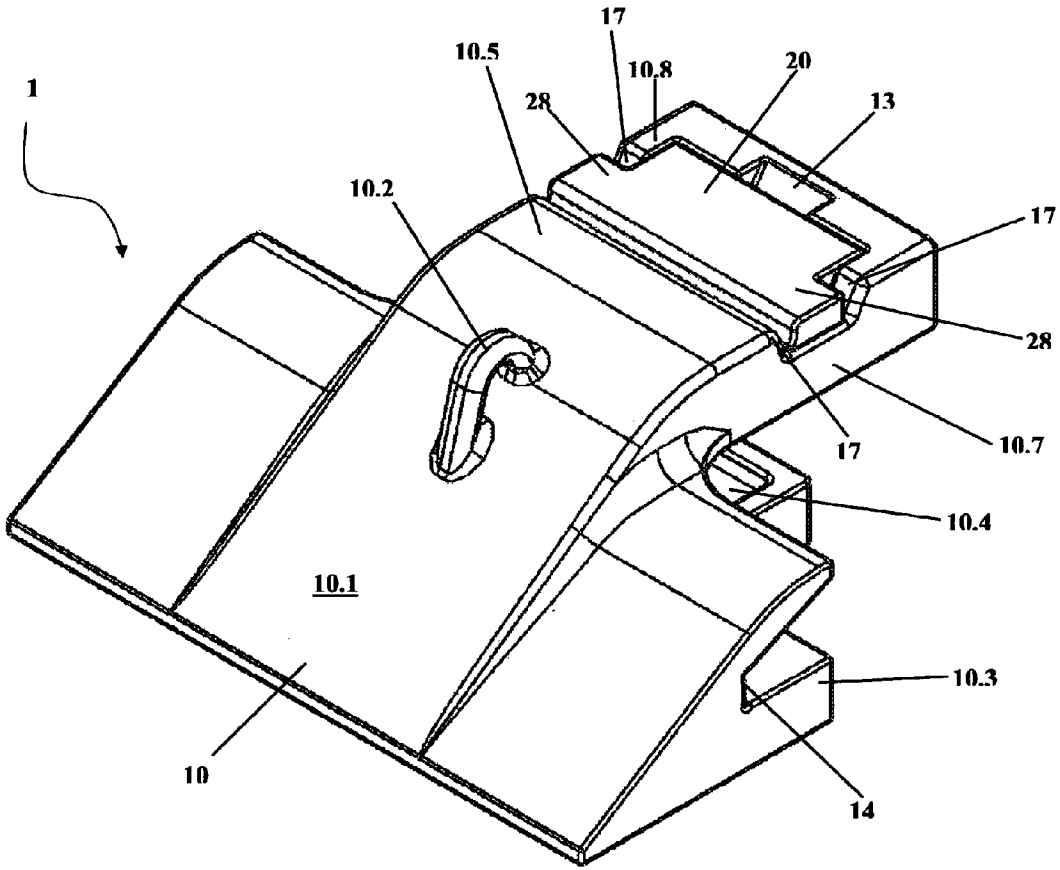
FIG. 1 illustrates a perspective view of an assembled base shroud and lock.
Figure 2:
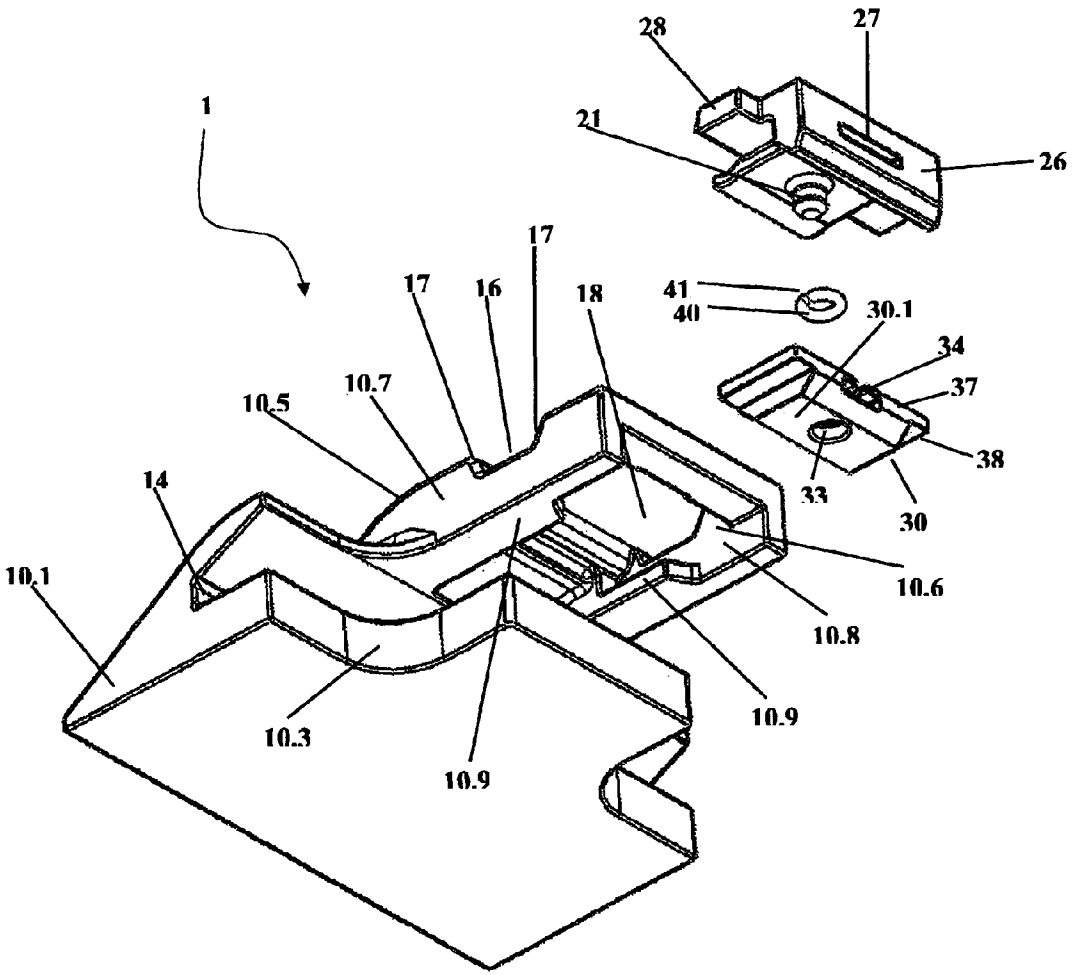
FIG. 2 illustrates a lower rear exploded perspective view of the components of the assembly of FIG. 1.
Figure 3:
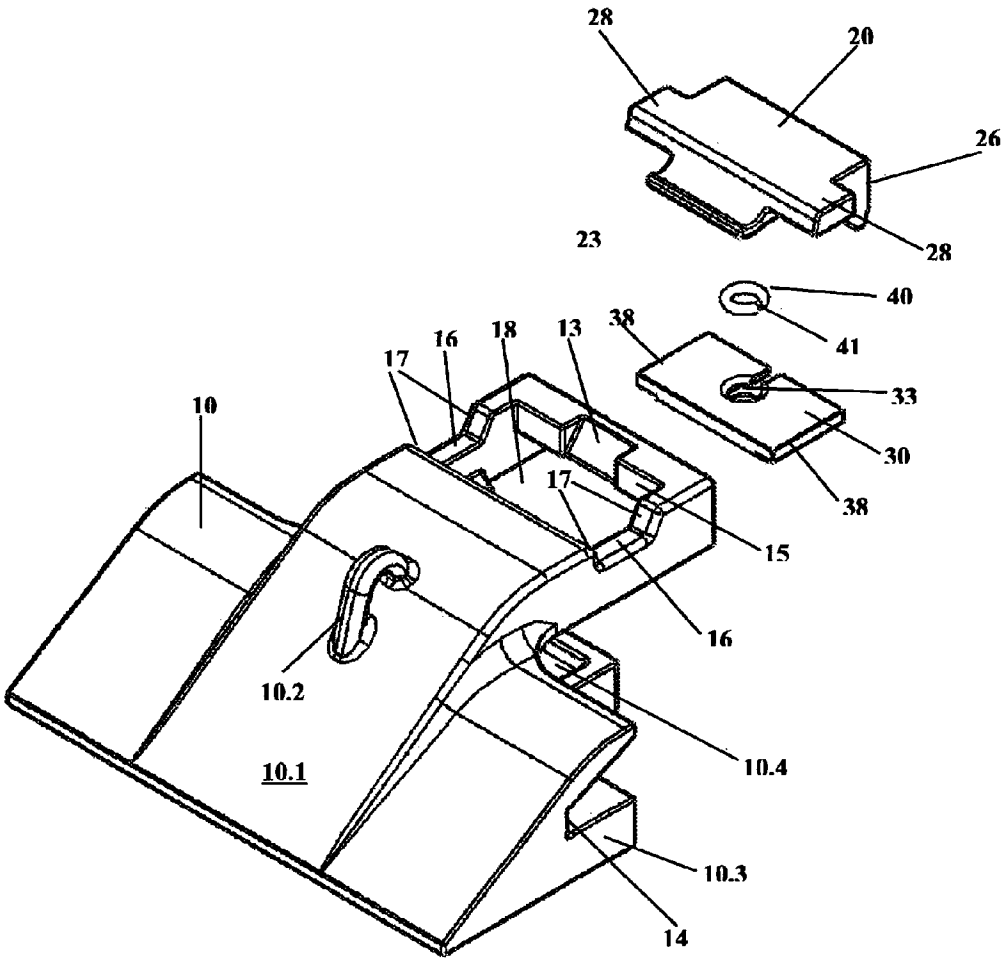
FIG. 3 illustrates an exploded perspective view of the base lock wear member and spring retainer.

Illustrated in FIGS. 1 to 9 is an assembly 1 including a wear member in the form of a shroud 10 which receives a leading edge or lip of an excavation bucket, a lock 20, a base 30 and as visible in FIG. 2, a retaining spring 40. For ease of illustration the assembly 1 is not shown on the lip of a bucket, but in the cross-section of FIG. 4 a phantom outline of the cross-section of such a lip 80 is illustrated The shroud 10, includes a forward digging tip 10.1 and a lifting hook 10.2. The rear of shroud 10 is bifurcated so as to receive lip 80. The lower arm 10.3 of the bifurcation is adapted to sit below the lip 80, and as can be seen in FIG. 3 preferably including a scallop formation 10.4 to decrease weight and the amount of metal in the shroud 10, and yet maintain the structural integrity of lower arm 10.3.

The upper arm 10.5 of the bifurcation includes aperture 18 which communicates from the upper wear surface of the shroud 10 to the base receiving formation 10.6 on the underneath side of upper arm 10.5.

The sides 10.7 and 10.8 of the upper arm 10.5 each include a depression 16, which has inclined lead in surfaces 17, the purpose of which will be described below.

The base receiving formation 10.6 includes flanges 10.9 at the base of each side 10.7 and 10.8 of the shroud 10.

The forward edge 11 of aperture 18 includes a connex curved edge, while the rearward edge of aperture 18 includes both abutment surfaces 15 and an inclined surface 13, the functions of which will be described below.

The base 30 is adapted to be welded to the upper surface of the lip 80 at a pre-determined distance from the front or foremost edge of the lip. For this purpose the base 30 is provided with bevelled lower front and rear edges 31 and 32 to allow for the fillet welding of the base 30 to the lip 80 of the bucket. The base 30 also includes flanges 38 on its sides which are spaced above the lower most surface 30.1 of the base 30.

Figure 9:
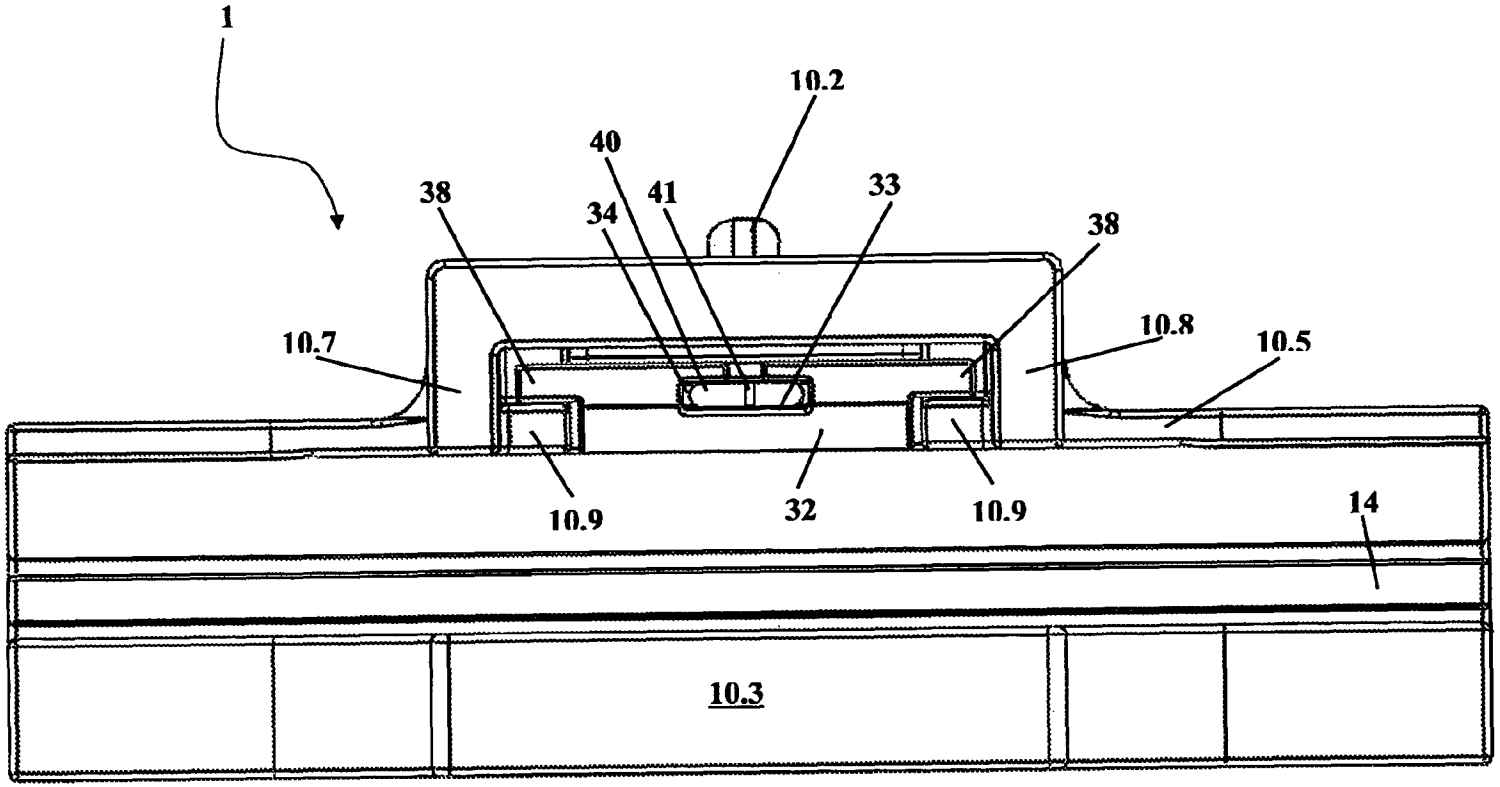
FIG. 9 illustrates a rear view of the assembly of FIG. 1.

As can be seen from FIGS. 2 and 3, the base 30 includes a circular aperture 33 (see also FIG. 9) which has a longitudinal axis which is generally perpendicular to the lip 80 of the bucket. Intersecting the aperture 33 is a passage 34 which opens into the rear surface of the base 30, and this is best seen in FIGS. 2 and 9.

Figure 7:
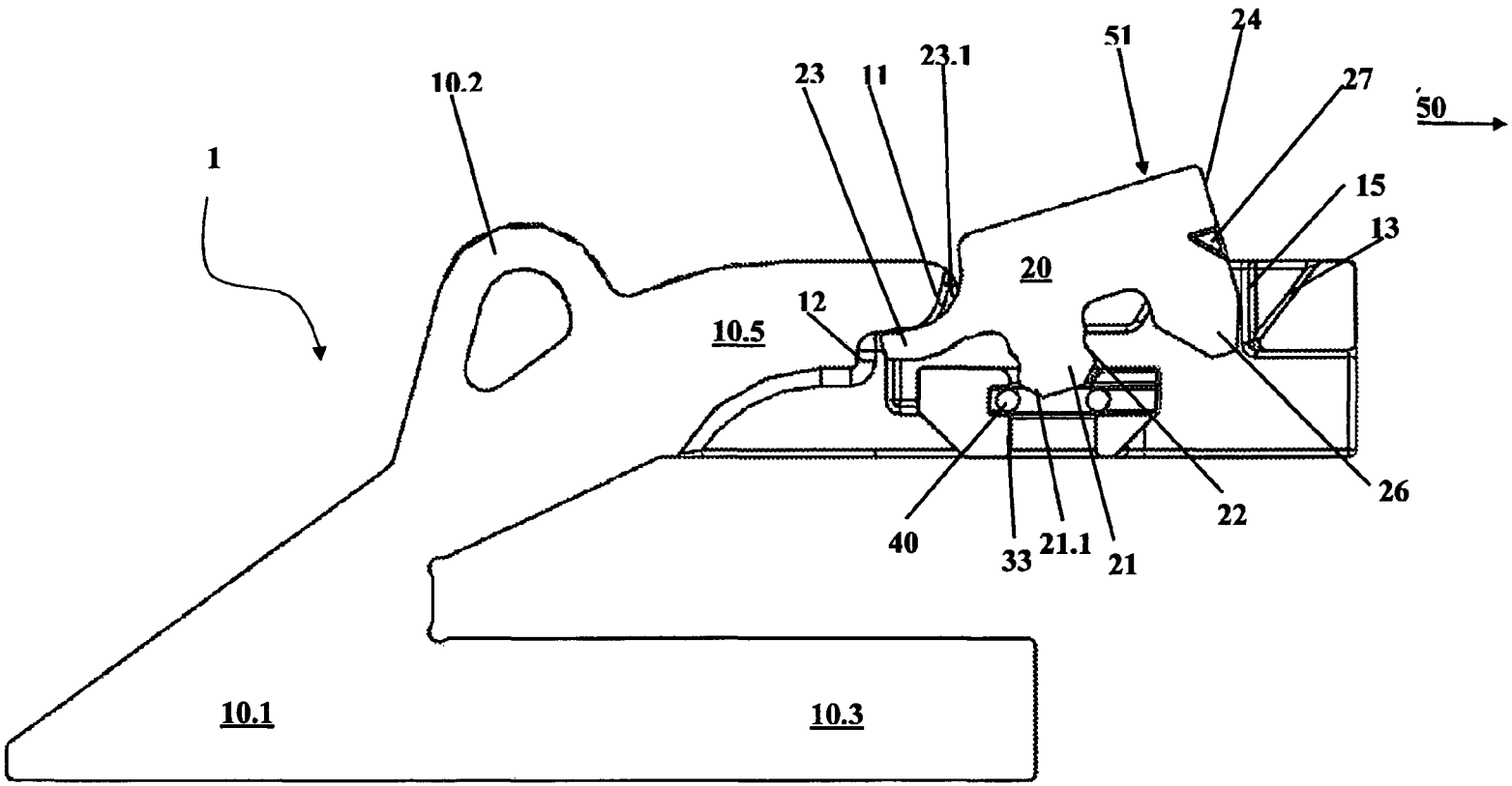
FIG. 7 illustrates a cross-section through the perspective view of FIG. 6.
Figure 8:
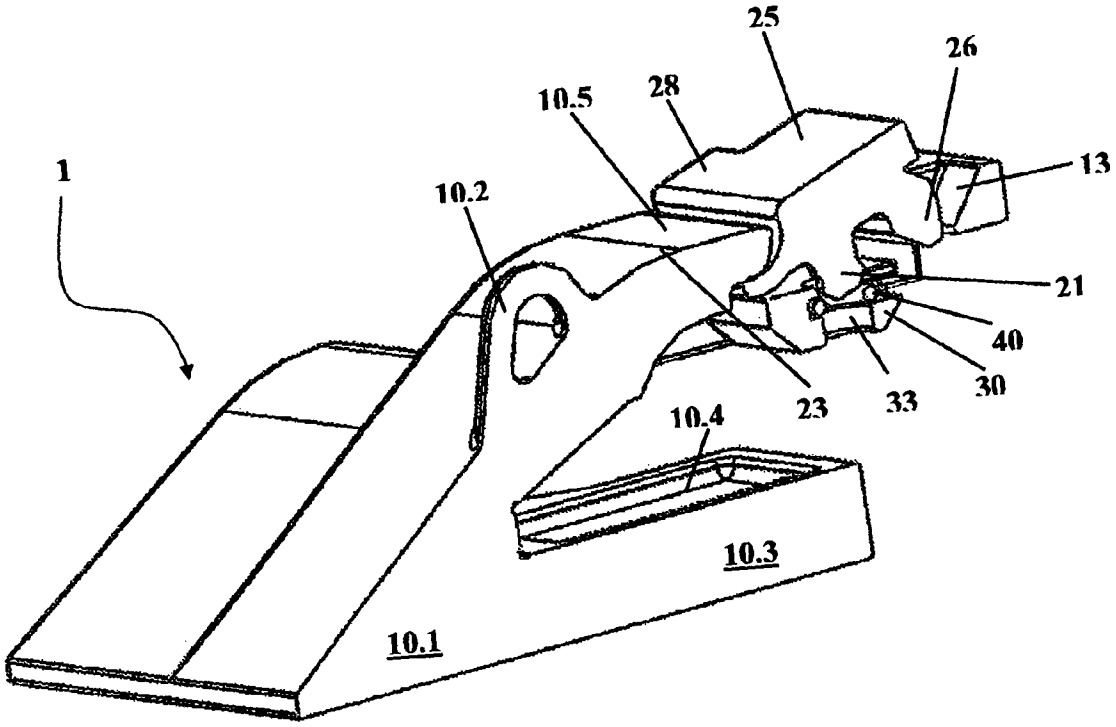
FIG. 8 illustrates a perspective view of the crosssection of FIG. 7.

The retaining spring 40, is of a toroidal construction and has a split 41 in its circumference so that the ends on either side of the split 41 can move apart to increase the internal diameter of the spring 40 if sufficient force is applied. The passage 34 allows the spring 40 to be positioned centrally with respect to, or aligned with, the aperture 33 so that a shaft or spigot 21 with a tapered or bevelled end 21.1 as illustrated in FIGS. 2 and 7 can force spring 40 open and pass through the spring 40 so that the spring 40 will be retained onto a groove 22 of the spigot 21.

Once base 30 has been welded onto the lip 80, the shroud 10 is slid or translated onto the lip 80 so that the lip 80 is received between the arms 10.3 and 10.5, while simultaneously, the base receiving formation 10.6 moves over the base 30 so that the flanges 10.9 will be received in the space between the flanges 38 of base 30 and the lip 80. The shroud 10 is pushed to the limit of its travel which is reached when the abutment surface 14 on the shroud 10 engages the forward-most edge of lip 80. In this condition, or relatively close thereto, the lock 20 can be installed as follows.

Figure 4:
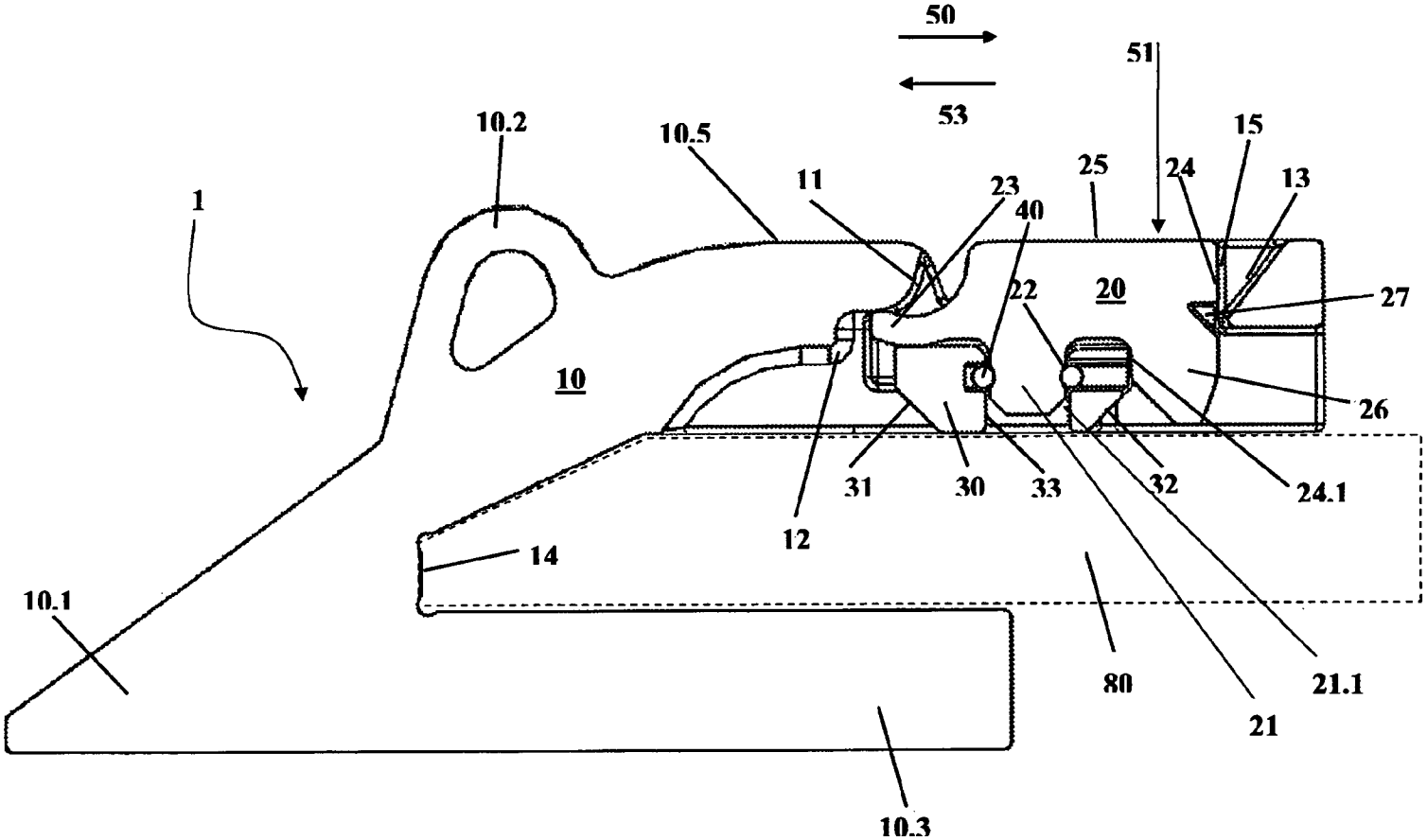
FIG. 4 illustrates a cross-section through the middle of the assembly of FIG. 1.
Figure 5:
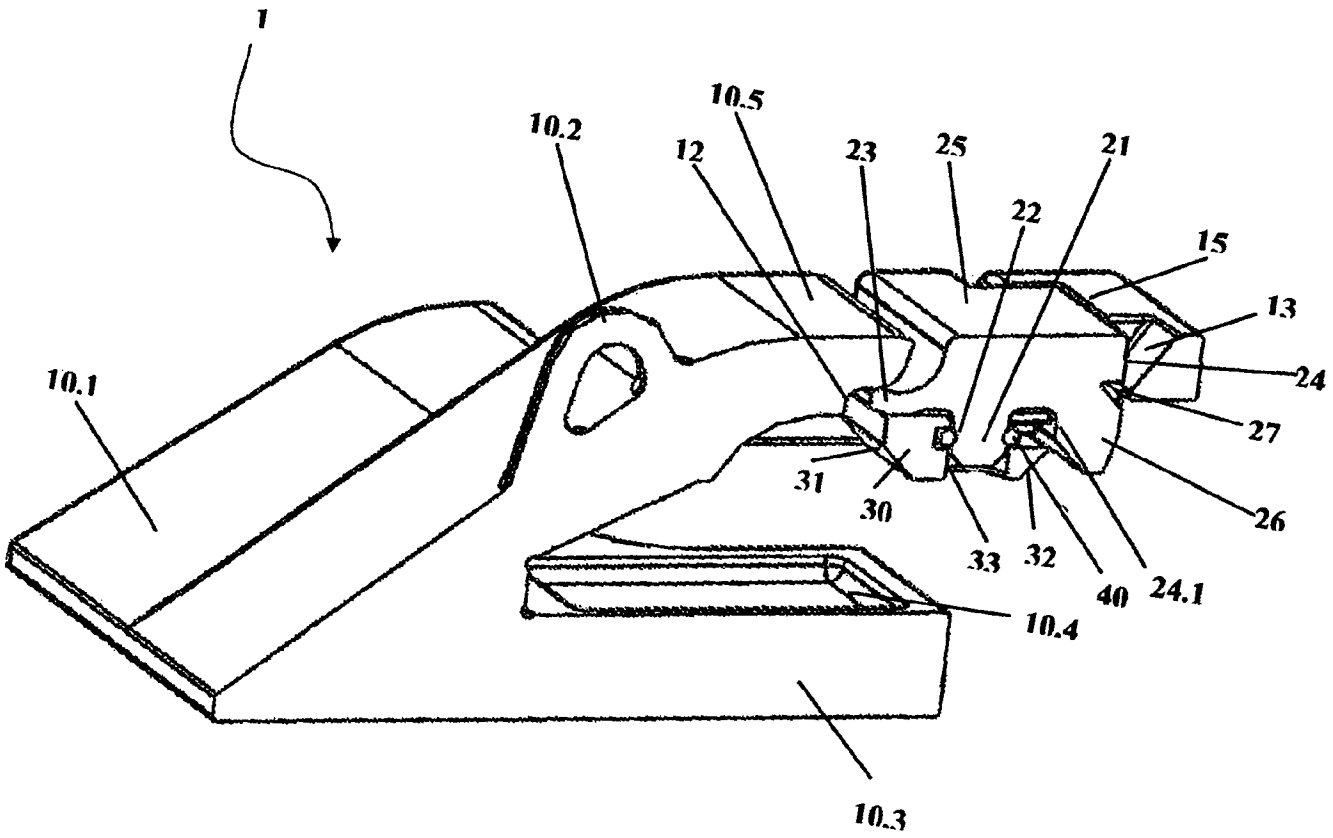
FIG. 5 illustrates a perspective view of the crosssection of FIG. 4.
Figure 6:
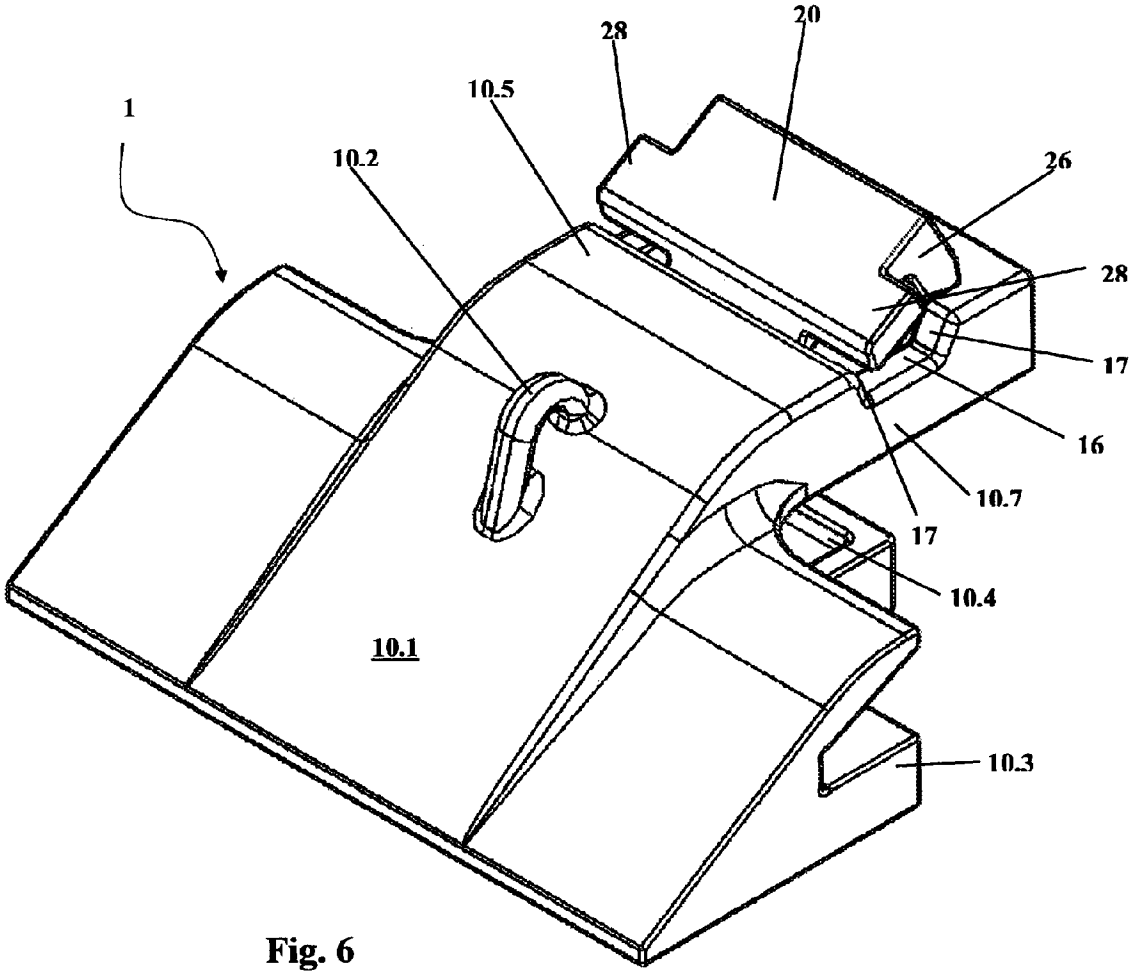
FIG. 6 illustrates a perspective view of the assembly with the lock in an unlocked condition.

The lock member 20, has a curved forward tongue 23 which extends forwardly from the body and which provides a bearing formation to allow the lock member 20 to pivot. At the rear of the lock member 20 is a transverse portion which includes, a rear abutment face 24, an inboard forwardly facing abutment face 24.1, an upper surface 25, a tapered longitudinal flange 26 and a pair of side extensions or wings 28. The lock member 20 in FIGS. 1, 4 and 5 is shown in the locked condition, whereas in FIG. 5 through to 7 the lock member 20 is shown in an unlocked condition.

To move the lock 20 from the locked to unlocked condition there is provided an inclined surface 13 on the shroud 10 and a lateral recess 27 in the centre portion of the rear face of lock. By an operator placing a crowbar with a pointed end down the inclined surface 13, so that the tip of a crowbar is sitting in the recess 27, the operator can simply lever the crowbar down or back which will then rotate the lock 20 from the locked condition of FIGS. 1, 4 and 5 to the unlocked condition of FIGS. 0 to 6, 7 and 8.

In addition to incline 13 and recess 27, the sides 10.7 and 10.8 of shroud 10 have depressions 16 which receive the wings or extensions 28 of the lock 20.

Each depression 16 includes a forward and rearward inclined surface 17. These surfaces 17 cooperate with the lower edge of wings 28 to provide a second or alternative location for a user to insert the tip of a lever or crowbar in order to pry or jimmy loose the lock 20 from base 30 and shroud 10.

The wings 28 also cooperate with the depressions 16, to provide more bearing surface for the lock 20 and to help locate and keep lock 20 at the appropriate height relative to both the shroud 10 and base 30.

The aperture 33 in the base member 30 is sized so as to allow downward movement of spigot 21 together with the small degree of rotation of the spigot 21 as it moves into the aperture 33 which result from the pivoting movement of the lock 20.

When the lock is first assembled the curved tongue 23 rotatingly engages the curved forward edge 11 of aperture 18. As the lock rotates the tapered flange 26 by being tapered helps to move the shroud 10 in the rearward direction of arrow 50 if it was not fully in a rearward location. Applying a downward force in the direction of arrow 51 to the lock 20 will cause the lock 20 to pivot around the end of the curved tongue 23 and forces the spigot 21.1 to rotatingly pass through the aperture 33 which in turn allows the spring 40 to be forced open by the bevelled or tapered termini of the spigot 21. After the spring 40 relatively passes the lower portion of the spigot 21 the groove 22 will be aligned with the location of the spring 40 and the elastic forces in the circumference of spring 40 will cause the inside diameter of spring 40 to enter into the groove 22. The force in the direction of arrow 51 can be applied by any means such as the heel of the operator's foot or by hammer or any appropriate means to push the lock 20 to its locked condition.

Referring to FIG. 4, when in the locked condition, the shroud 10 is not restrained from moving in a rear direction 50 by means of the lock member 20. That is, the abutment surface 14 when it engages the forward most extremity of the lip 80 prevents the shroud 10 moving any further in the direction of arrow 50 relative to the lip. However, for movement in the opposite direction, namely that indicated by arrow 53, the shroud 10 is held onto the lip 80 and is not able to move in the direction arrow of 53 because the abutment surface 24, which is held stationary relative to the base 30 (because of the engagement of the forward facing abutment surface 24.1 with the rear face or edge of the base 30) engages a corresponding abutment surface 15 on the shroud 10.

The lock member 20 is not expected to be subjected, during use after installation, to any sufficiently large enough vertical forces relative to base 30, which would cause the lock 20 to rotate to an unlocked condition. The spring 40 on the groove 26 of spigot 21 will maintain the lock 20 in the locked condition during the service life of the assembly. It is only when a sufficient upward force is applied to the lock 20 to overcome the elastic force from spring clip 40 that the lock 20 will move to the unlocked condition.

To separate the shroud 10 from the base member 30 the lock member 20 must be first moved to an unlocked condition with the lock member 20 preferably being completely removed from the assembly.

The above describes the use of a toroidal shaped spring or spring clip 40, that is it is doughnut ring or in cross section it will reveal a pair of circles as in FIG. 4. If desired other shaped springs or spring clips can be utilised such as a square or rectangular toroid, that is in cross section two rectangles or two squares would be seen. Such a change in cross section may also require a change in the shape of the groove 22.

If desired, a threaded hole through a portion of the lock 20, such as through the body of the lock 20, or the wings 28, so that long bolts (not illustrated) can be inserted therein to engage the lip 80, the base 30 or the shroud 10 and turned so as to act like a screw jack, thereby providing the necessary pivoting motion to the lock member relative to the shroud and the base to overcome the spring or spring clip 40. Such threaded holes may require caps to prevent them being filled with fines during use of the bucket or implement.

As illustrated in FIGS. 11 to 14 is a wear assembly which is a tile shroud arrangement which has a tile shroud 100 which releasably locks to a tile shroud base 300.

A tile shroud base 300 is to be welded to a surface to be protected, such as a bucket, a chute, a mill, a haul truck's payload tray or an earth, ore or mineral handling apparatus, by means of apertures 302 at either end of the base 300. The apertures 302 provide an edge for a fillet weld to be positioned where the rim of the apertures 302 meet the surface to which it is to be welded.

As the tile shroud can be assembled on a surface to be protected in any orientation, the base 300 does not have a front or rear end as such. At one end of the base is a longitudinal tongue or protrusion 301, which provides an overhang for the engagement of the tile shroud 100 as described later. At the opposite side to the location of the tongue 301 is an aperture 33 which passes through the upper and lower surfaces of the base 300. Passing through a side face of the base 300 is an aperture 34 which intersects with the aperture 33, so as to enable a split toroidal spring 40 to pass into register with the aperture 33, via the aperture 34.

As can be seen from FIGS. 10 to 14 the shroud tile 100 has a main body portion or upper 103 which has a peripheral wall 101 at its outer edge. Extending downwardly from an underside of the shroud tile 100 is a shaped spigot or shaped shaft 21, which has a tapered or bevelled end 21.1, which like the previously described embodiment, allows the spigot 21 to open the spring 40, which is split at 41, as it passes through the spring 40, so that the spring 40 will be able to enter the groove 22 located above the bevelled end 21.1.

Figure 10:
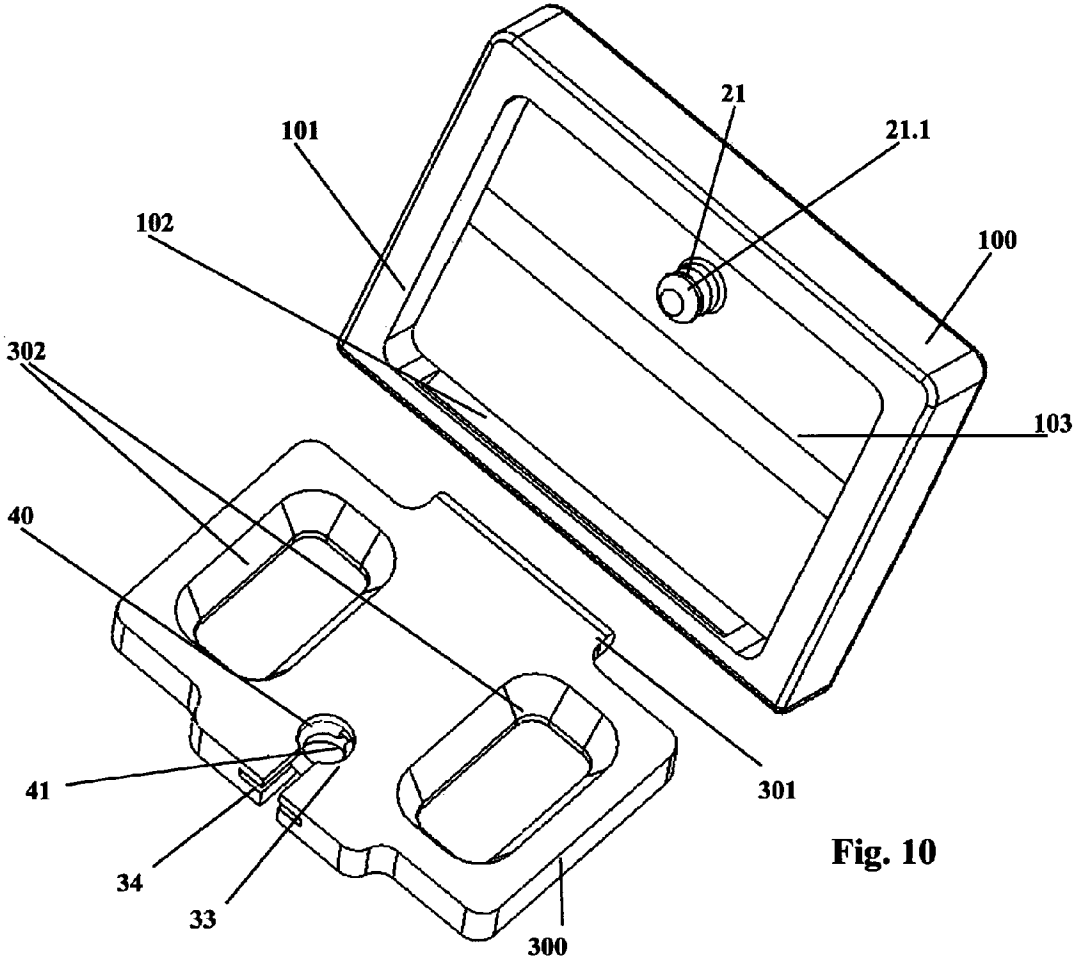
FIG. 10 illustrates a perspective view of a tile shroud and base having a locking system.
Figure 11:
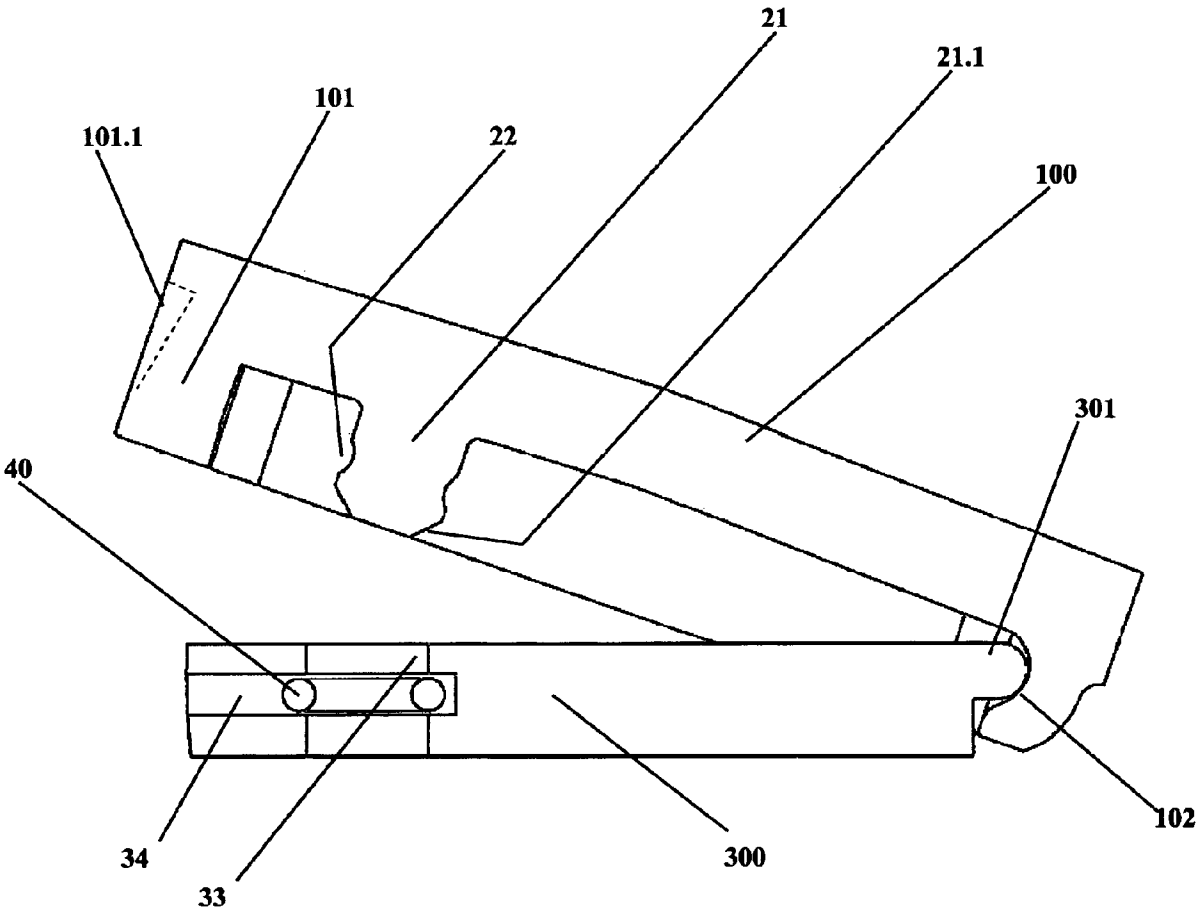
FIG. 11 illustrates the tile shroud base and locking system of FIG. 10 in cross section as these components are being locked together.
Figure 12:
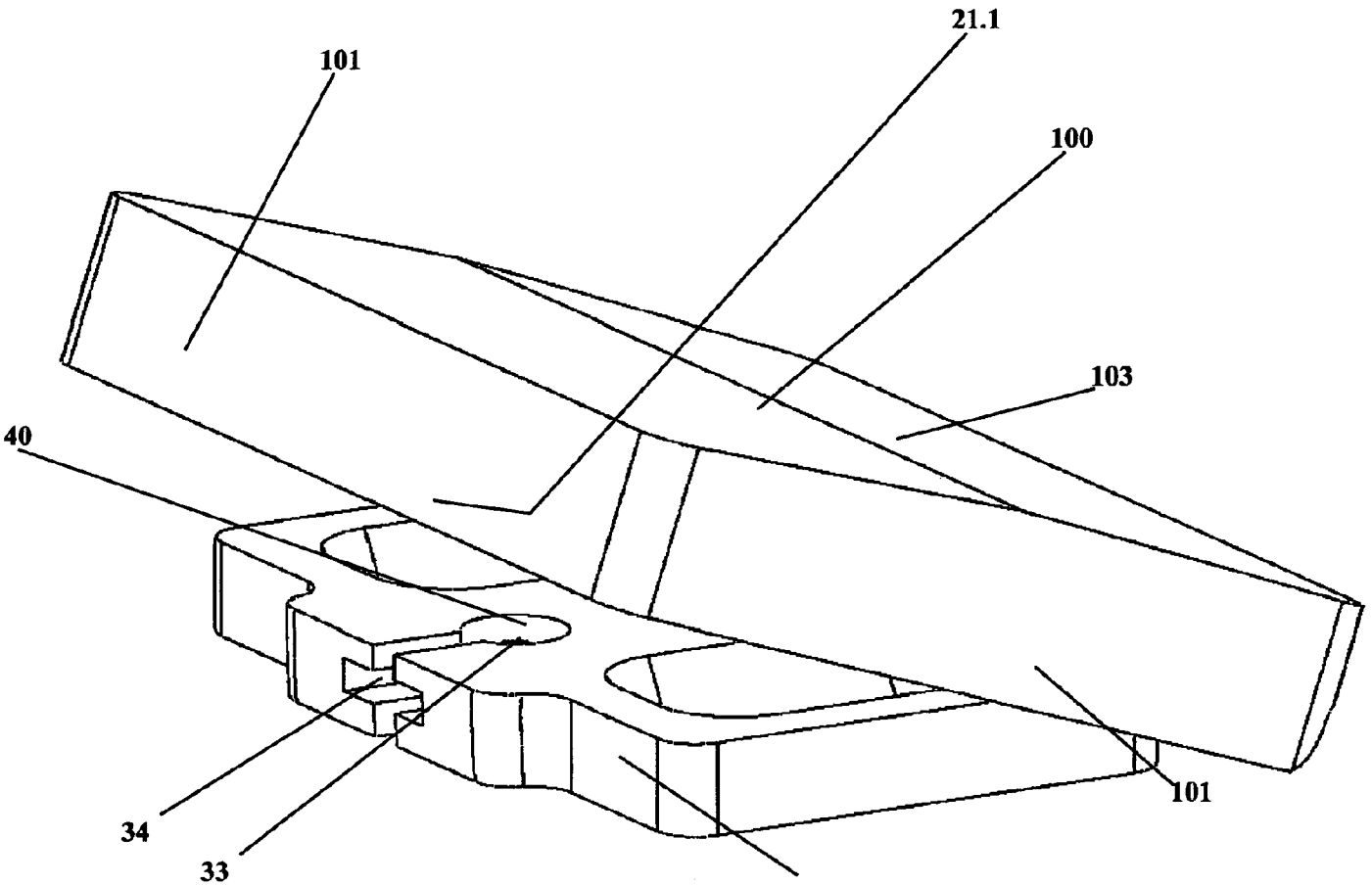
FIG. 12 illustrates an upper perspective view of the FIG. 11 components.
Figure 13:
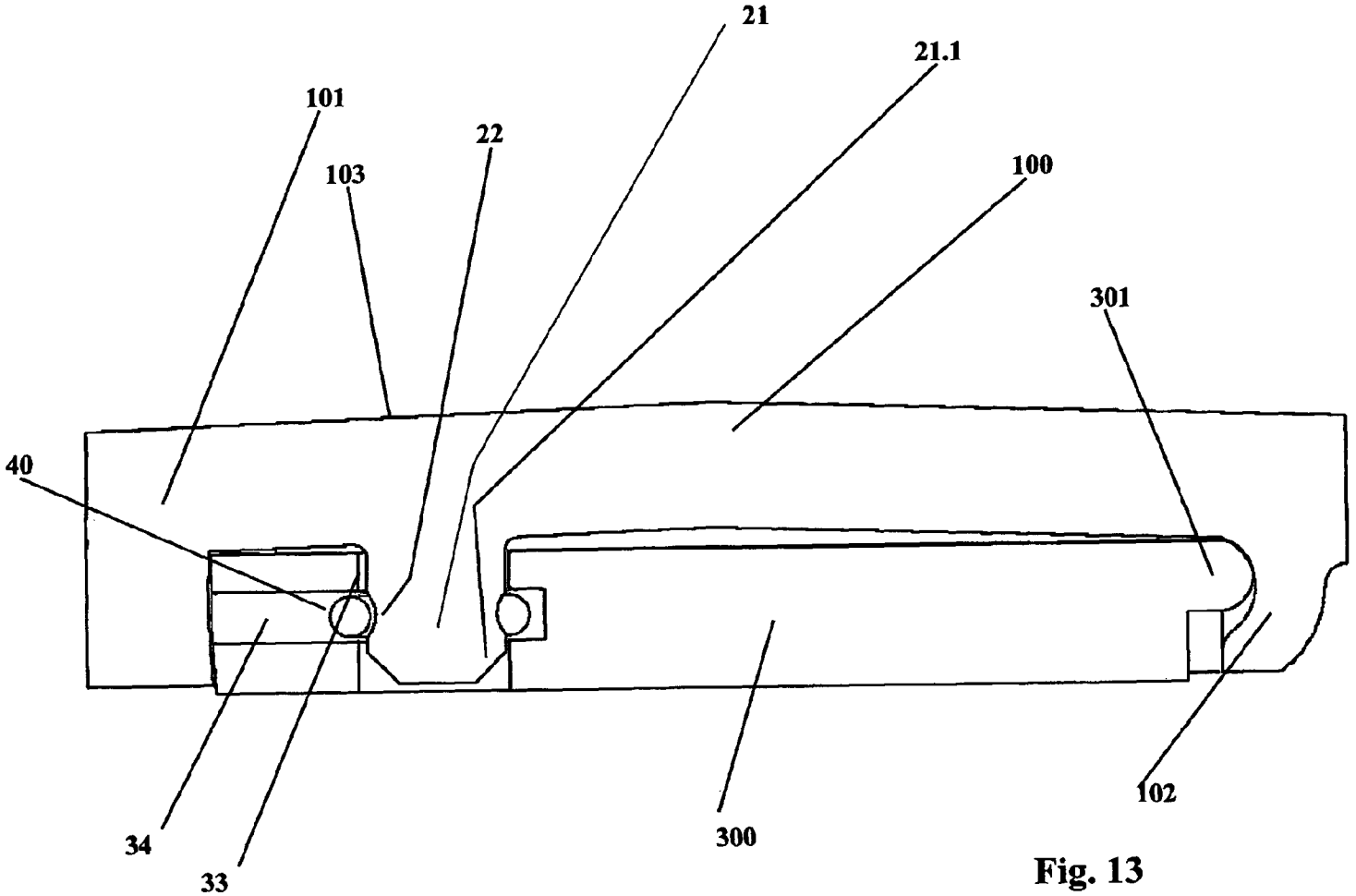
FIG. 13 illustrates a cross section through the components of FIG. 10 when they have been locked together.
Figure 14:
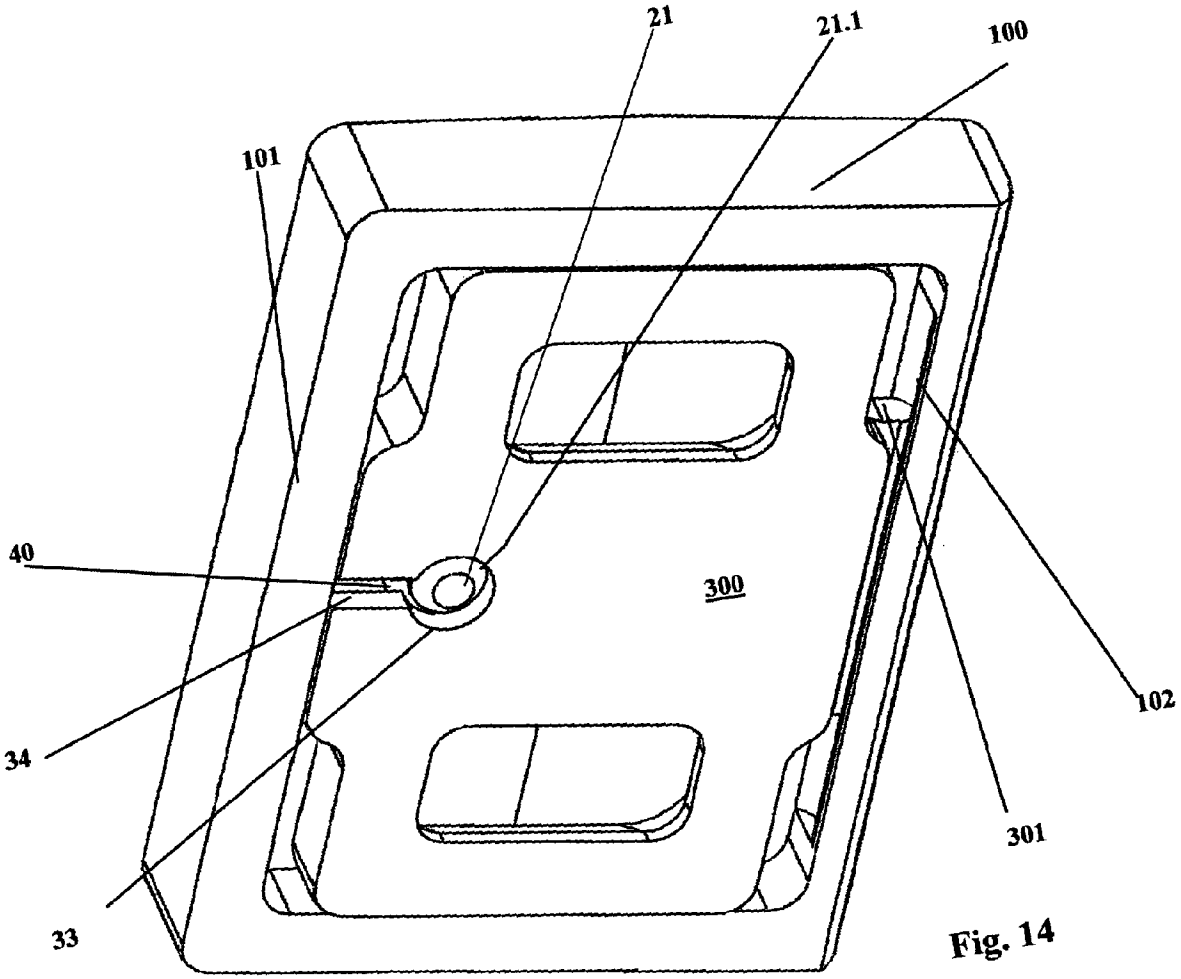
FIG. 14 illustrates an underneath perspective view of the components of FIG. 13.

Visible in FIGS. 10 and 11, on the inside of the peripheral wall 101, at a location opposite to the location of spigot 21, is a longitudinal undercut or recess 102 having a curved shape in cross section and which is sized and shaped so as to pivotally engage the tongue 301 described above on the base 300. By both the recess 102 and the tongue 301 having a curved profile in cross section, this will allow ready rotation or pivoting when the tile shroud 100 is attached to the base 300, as is illustrated in FIGS. 11 and 12, with the tongue 301 being engaged by the recess 102 providing a hinge or pivot means so that the two can be rotated together. Once this rotation or pivoting has resulted in the bevel 21.1 engaging the spring 40, by application of a large enough force, eg stamping with a foot or hitting with a hammer, the spigot 21 will push through the spring 40 thereby expanding it, and the spring 40 will enter the groove 22, where it will be held. This will lock the tile shroud 100 to the base 300, as the tile shroud 100 will not lift off the base 300, because the tongue 301 is captured within the recess 102, and spigot 21 is captured in aperture 33.

If desired, as illustrated in FIG. 11, an undercut 101.1 can be provided on the outer side of the peripheral wall 101. The undercut 101.1 can be used to apply a force by leverage for example by a crow bar or the like, to the underside of the shroud tile 100, when it is desired to disassemble the tile shroud 100 from the base 300.

The embodiment of FIGS. 10 to 14 differs from that described above with respect to FIGS. 1 to 9, in that the spigot 21 is not located on a separate lock member, instead it is formed directly onto the wear member, in this case tile shroud 100.

Figure 15:
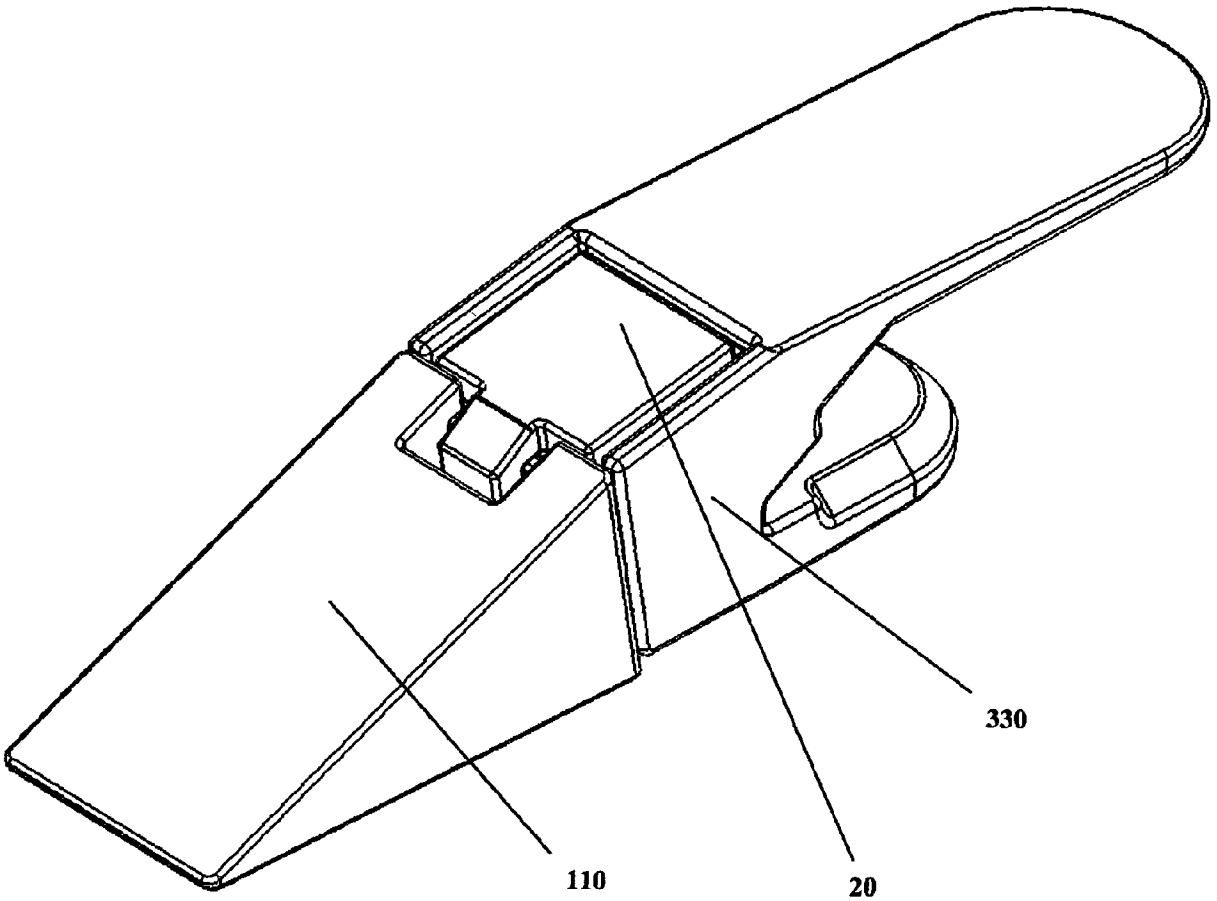
FIG. 15 illustrates in perspective view a replaceable tip and adaptor having a locking system.
Figure 16:
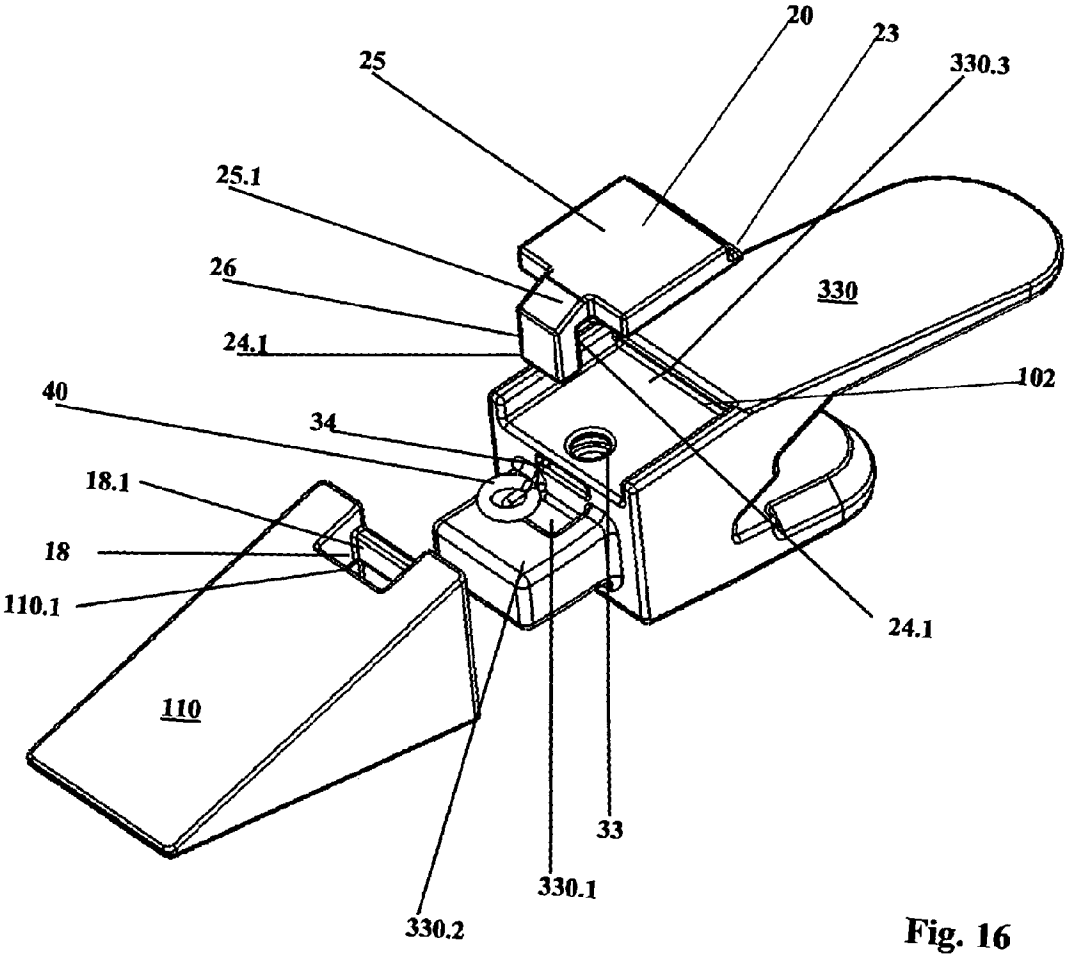
FIG. 16 illustrates in perspective exploded view the components of FIG. 15.
Figure 17:
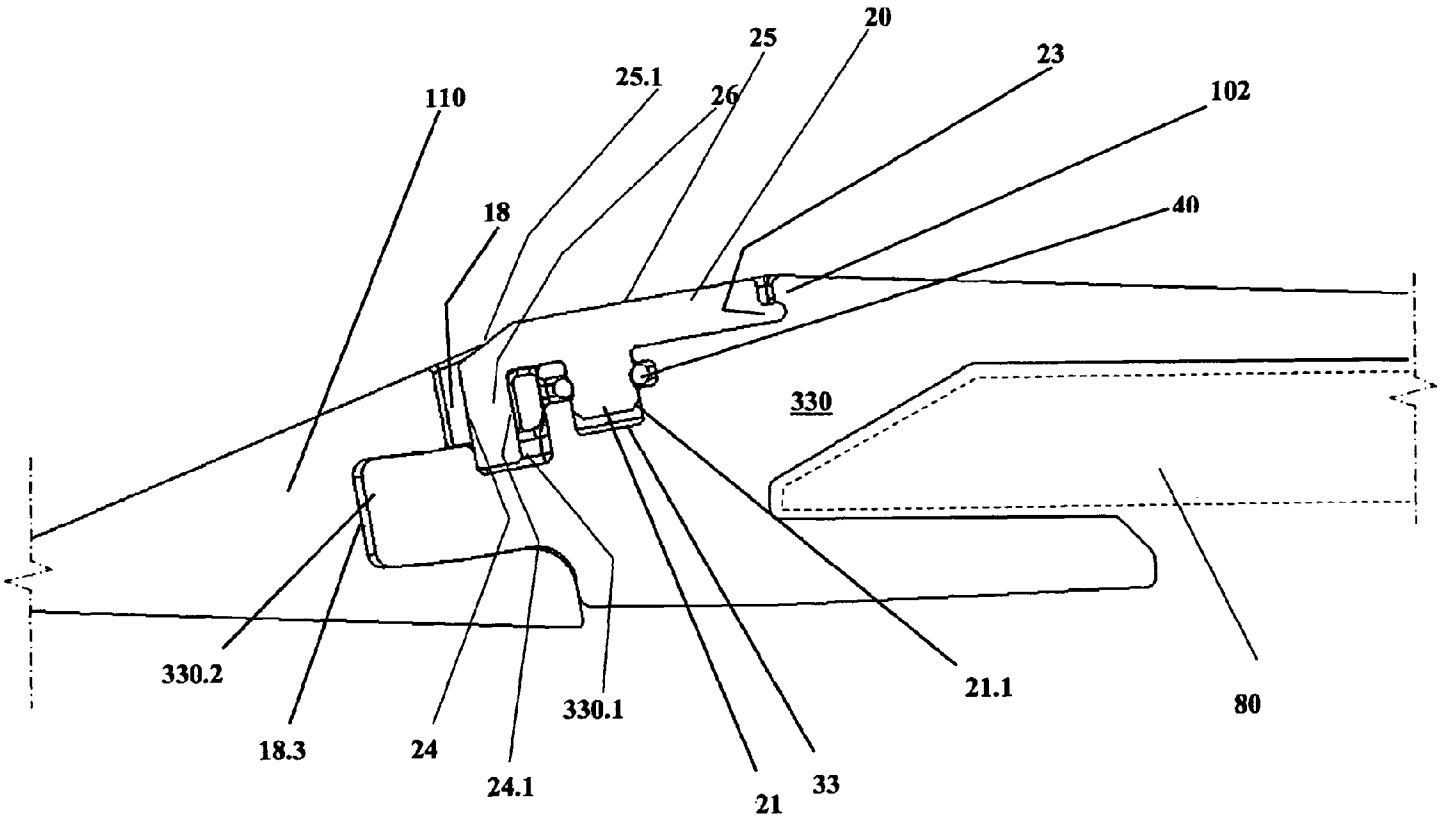
FIG. 17 illustrates in cross section the assembly of FIG. 15.

Illustrated in FIGS. 15 to 17, is another embodiment which is similar in construction to that of FIGS. 1 to 9, except that in FIGS. 15 to 17, the wear assembly is made up of a replaceable tip 110, mounted to a base which is an adaptor 330 that can be mounted to the front digging edge 80 of a bucket, and a lock member 20 which engages both to lock the two together to prevent them separating in use.

As illustrated in FIGS. 16 and 17, the adaptor 330 in addition to being bifurcated to receive the lip 80, has a transverse aperture 33 extending downwardly from it. The aperture 33 intersects with another transverse aperture 34. The aperture 34 is sized and shaped so as to receive a toroidal spring 40 having a split 41, and is of sufficient length so as to allow the spring 40 to be concentrically located with respect to the aperture 33. It will also be noted that the adaptor 330 has an upwardly opening walled recess 330.1 which is located on a forwardly projecting tongue 330.2. The tongue 330.2 allows for proper alignment of the tip 110 onto the nose of the adaptor 330.

The adaptor 330 also includes a rebated or recessed portion 330.3 which will receive the body of the lock member 20, thereby ensuring that the upper surface 25 of the body of lock 20 will not sit proud of the general upper level of the adaptor 330.

As is best seen in FIG. 17, the rear edge of the recessed portion 330.3 includes an undercut portion 102, which has a generally curved shape in cross section, so as to provide a pivot or rotation bearing formation, when it is engaged by a tongue 23 at the rear of the lock member 20.

As is illustrated in FIGS. 16 and 17, the lock member 20 has an upper surface 25 and at a forward end of this is a bevelled front face 25.1. This face 25.1 and its forward extension to below the rear edge 110.1 of aperture 18 in the tip 110, or near thereto, ensures that any forces applied to the block 20, when the tip is engaging earth or such like, assists in forcing the lock 20 into a locking direction rather than an unlocking direction.

Extending away from the surface 25.1 is a transverse portion 26 which has a forward abutment face 24 to engage the forward wall of the walled recess 330.1, and a rearward abutment 24.1 to engage a rearwardly located wall 18.1 (which is forwardly facing) of the aperture 18.

The lock member 20 also includes a spigot 21 having a tapered end 21.2 which extends away from the body or undersurface of the lock 20. The rear of the lock 20 also includes a pivot tongue 23 which can be received by and engages with the undercut 102 on the adaptor 330.

The replaceable tip 110 as described above includes a generally wedge shape ground engaging region while the mounting region includes the aperture 18 and its rear wall 18.1. The aperture 18 leads to a lateral or longitudinal recess 18.3 into which can be received the tongue 330.2 on adaptor 330.

To assemble the wear assembly of FIGS. 15 to 17, the spring 40 is first located in to the aperture 34 and pushed to the end of the aperture where it will be close enough to concentrically located with aperture 33. It does not need to be exactly concentric as the tapered or bevelled end 21.1 of spigot 21 will accommodate some misalignment. Once the spring 40 is in place, the tip 110 is placed onto tongue 330.2 and pushed towards the adaptor 330, until it cannot move any further. In this condition the rear face of wall 18.3 will block the aperture 34, preventing the split spring 40 from exiting the aperture 34.

Once in this condition the rear edge or tongue 23 of the lock 20 is made to engage the undercut 102 on the adaptor 330 and the lock 20 pivoted so that the spigot 21 will enter the aperture 33 and the transverse portion 26 will enter the aperture 18. As the spigot 21 gets pushed past the spring 40, the spring 40 will open and then will be located onto the groove 22. As this happens the lower end of the transverse portion 26 will also enter the recess 330.1 on the tongue 330.2 and the three components will be locked together.

If desired the front face of the transverse member 26 can be provided with an undercut similar to undercut 101.1 of FIG. 11, so that a crow bar or similar tool can be inserted therein and a lifting force to produce an unlocking rotation can be provided to the lock member relative to the tip 110 and the adaptor 330. It is for this reason that a relatively large gap can be provided between the forward wall (rearwardly facing) of aperture 18 and the forward face of the transverse member 26.

The lower extremity of transverse member 26 can be provided with a taper so as to allow for some misalignment of the adaptor and the tip, but in this case the recess 330.1 will need to be deeper than that illustrated in FIG. 17.

In respect of the above described wear assemblies, the spring 40 can be retained in the aperture 34 by means of a rubber plug or similar, so as to keep the spring 40 captured therein no matter what orientation assembly may occur at.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A wear assembly comprising:

a wear member to be mounted to an implement or apparatus to be protected, a base to be attached to the implement or apparatus, a lock to lock said wear member to said base, said wear member including or receiving said lock, and said base including at least one aperture in which is located a releasable retaining means to releasably hold a portion of said lock; and wherein said wear member, in the vicinity of said aperture, includes engaging surfaces against which said lock pivots into and out of a locked condition, in which locked condition said wear member is secured and locked to said base and thus said implement, and wherein said lock has a forward projection which allows said lock to pivot.

2. A wear assembly as claimed in claim 1 wherein said portion of said lock is at least one of a shaft, a spigot, and a shaped shaft or a shaped spigot.

3. A wear assembly as claimed in claim 1 wherein said releasable retaining means includes at least one of a spring and a spring clip which will engage a groove on said portion of said lock.

4. A wear assembly as claimed in claim 1 wherein the engaging surfaces are of a curved profile.

5. A wear assembly as claimed in claim 1, wherein one or both of said lock or said wear member includes a lever engagement formation which allows a user to utilise a lever to pivot said lock or said wear member from a locked to an unlocked condition.

6. A wear assembly as claimed in claim 3, wherein said spring clip of said base and a groove on said portion provides a force to prevent said lock or said wear member from pivoting during use of said implement or apparatus.

7. A wear assembly as claimed in claim 3, wherein said spring clip is located in said base in a passage which opens through a surface of said base which is at approximately 90 degrees to said at least one aperture.

8. A wear assembly as claimed in claim 3, wherein said spring clip will only release said portion and said groove of said lock when a force in a direction opposite to a lock engagement direction is applied to said lock or said wear member relative to said base.

9. A wear assembly as claimed in claim 1 wherein said lock portion includes at least one tapered engagement surface which will expand said spring clip as said lock portion moves into said at least one aperture.

10. A wear assembly as claimed in claim 1, wherein said lock is separate from said base and said wear member, said wear member including means to receive said base in a first direction and having a lock receiving aperture which opens in a second direction so that at least a portion of said lock can move into said lock receiving aperture to engage said base, and which allows said portion of said lock to be received in said aperture in said base.

11. A wear assembly as claimed in claim 10, wherein said lock includes at least one first bearing surface to engage or abut said wear member or said base, and at least one second bearing surface to engage or abut said base thereby preventing said wear member from moving relative to said base in a direction opposite to said first direction.

12. A wear assembly as claimed in claim 10, wherein said wear member includes an abutment surface to engage said base or said implement or apparatus, said abutment surface once engaged with said base or said implement or apparatus will prevent said wear member from moving further in said first direction.

13. A wear assembly as claimed in claim 10, wherein said lock includes wings that cooperate with said wear member to thereby enable said lock to be moved or assisted to be moved to an unlocked condition by means of a crow bar or lever pivotably engaging said wings and said wear member.

14. A wear assembly as claimed in claim 3, wherein said spring clip is not able to exit said passage once said wear member is arranged on said base.

15. A wear assembly as claimed in claim 1 wherein said wear member is one of a shroud; a tile shroud; a tooth; and a replaceable tip;

said base is one of a base for a shroud, a base for a tile shroud, an adaptor for a tooth, and an adaptor for a replaceable tip; and said implement or apparatus is one of an excavation bucket; a grader blade; a chute; an excavation bucket edge; an excavation bucket surface; dump or haul truck load carrier; a mill; and an earth, ore or mineral handling apparatus.

16. The wear assembly as claimed in claim 1, wherein said forward projection has a bearing formation that pivots against at least one of said engaging surfaces of said wear member.

* * * * *